US010900229B2

(12) United States Patent
Scherrer et al.

(10) Patent No.: US 10,900,229 B2
(45) Date of Patent: Jan. 26, 2021

(54) HANGER PROFILE AND CEILING ASSEMBLY

(71) Applicants: Jean-Marc Scherrer, Riedisheim (FR); Damien Lang, Strasbourg (FR)

(72) Inventors: Jean-Marc Scherrer, Riedisheim (FR); Damien Lang, Strasbourg (FR)

( * ) Notice: Subject to any disclaimer, the term of this patent is extended or adjusted under 35 U.S.C. 154(b) by 0 days.

(21) Appl. No.: 16/327,132

(22) PCT Filed: Aug. 17, 2017

(86) PCT No.: PCT/FR2017/052238
§ 371 (c)(1),
(2) Date: Feb. 21, 2019

(87) PCT Pub. No.: WO2018/037184
PCT Pub. Date: Mar. 1, 2018

(65) Prior Publication Data

US 2019/0186133 A1 Jun. 20, 2019

(30) Foreign Application Priority Data

Aug. 24, 2016 (FR) ..... 16 57910
Dec. 28, 2016 (FR) ..... 16 63456

(51) Int. Cl.
*E04B 1/12* (2006.01)
*E04B 9/02* (2006.01)
(Continued)

(52) U.S. Cl.
CPC ..... *E04B 9/02* (2013.01); *E04B 9/303* (2013.01); *F24F 7/04* (2013.01); *E04B 2009/026* (2013.01)

(58) Field of Classification Search
CPC ..... E04B 9/006; E04B 2009/026; E04B 9/02; E04B 9/303; E04B 9/30; E04B 5/48;
(Continued)

(56) References Cited

U.S. PATENT DOCUMENTS 4,676,016 A * 6/1987 Phillips ..... B44C 7/022 160/383
4,817,699 A * 4/1989 Fein ..... B44C 7/022 160/327
(Continued)

FOREIGN PATENT DOCUMENTS

EP 0338925 A1 10/1989
FR 2619531 A1 2/1989
(Continued)

*Primary Examiner* — Chi Q Nguyen
(74) *Attorney, Agent, or Firm* — Bachman & LaPointe, P.C.

(57) ABSTRACT

A canvas hanger profile for making a stretched ceiling in a room to be conditioned, the hanger profile comprising at least two wings connected together by a connecting lining, one of the wings being arranged to allow the fastening of the hanger profile on a wall of the room to be conditioned, a second wing, which constitutes a canvas hanger wing, being provided with a blocking end of a canvas hook, wherein the connecting lining and the hanger wing are arranged to define together an unclosed air passage slot through the profile and are delimited by the blocking end of the hanger wing hook, the profile having at least one through opening arranged to allow air to pass through said profile from or towards the slot.

17 Claims, 11 Drawing Sheets

(51) Int. Cl.
*E04B 9/30* (2006.01)
*F24F 7/04* (2006.01)

(58) Field of Classification Search
CPC . F24F 7/04; E04F 13/005; E04F 13/00; E04F 13/045; E04F 13/06
USPC ..... 52/63, 715, 708, 710, 712, 714
See application file for complete search history.

(56) References Cited

U.S. PATENT DOCUMENTS

| | | | | |
|---|---|---|---|---|
| 5,029,422 | A | 7/1991 | Scherrer | |
| 6,959,518 | B2 | 11/2005 | Cousin | |
| 7,712,263 | B1 * | 5/2010 | Lippie | E04B 1/72 52/101 |
| 9,205,699 | B1 * | 12/2015 | Reilly | B44C 7/022 |
| 10,533,324 | B2 * | 1/2020 | Baltz, Jr. | E04F 19/04 |
| 2007/0283656 | A1 * | 12/2007 | Anderson | E04B 9/303 52/506.06 |
| 2010/0077686 | A1 * | 4/2010 | Bowen | E04B 9/303 52/506.06 |
| 2016/0024801 | A1 * | 1/2016 | Scherrer | E04F 13/005 52/28 |
| 2017/0254091 | A1 * | 9/2017 | Friel | E04B 1/765 |

FOREIGN PATENT DOCUMENTS

| | | | |
|---|---|---|---|
| FR | 2721051 | A1 | 12/1995 |
| WO | 0206604 | A1 | 1/2002 |

* cited by examiner

HANGER PROFILE AND CEILING ASSEMBLY

BACKGROUND OF THE INVENTION

The invention concerns the field of false ceilings, and in particular that of stretch ceilings.

The invention concerns more particularly a profile for hanging a canvas for the implementation of a stretched ceiling in a room allowing air to be circulated within it.

The circulated air can come from a ventilation and/or air conditioning system (heating, cooling, dehumidification, humidification).

Examples are known of false ceilings allowing air to pass through the room to be conditioned. In particular, there is a false ceiling fixing system that allows the hanger profiles of the false ceiling to be spaced apart by means of brackets or spacers fixed at regular intervals, thus generating a peripheral space. For example, patent application FR2815112 can be cited.

However, the systems or profiles of the prior art do not allow precise control of the diffusion of air at the periphery of the room. Furthermore, they do not make it possible to avoid air inlet grilles which are commonly used and which are detrimental to the aesthetics of the room.

On the other hand, document FR 2 619 531 describes a canvas hanger profile, the central core of which is closed by a pass-through flexible blade locking a non-deformable hook for hanging the canvas, the flexible blade having several perforations as well its side opposite to its fixing wing for fixing to the wall. These perforations are in the form of segments having a smaller width than those of the screws for fixing the profile to the wall with a relatively limited length, while also being spaced apart from each other, not allowing for an easy circulation of air between the plenum and the room, especially since the central core of the profile is almost completely blocked by the flexible blade holding the hook of the canvas.

Also, the international application WO 02/06604 describes a hanger profile for canvas, both of which opposite fixing wings to the wall and to the canvas, have perforations allowing air to circulate above the canvas, but whose central core is closed by a flexible blade for the passage and blocking of a non-deformable hook, which also closes the space between the wall and the fixing side, preventing any air circulation between the plenum and the room separated from each other by the canvas.

SUMMARY OF THE INVENTION

The invention aims to solve these problems by proposing a hanger profile for the simple and fast mounting of a ceiling assembly allowing the circulation of fresh and/or conditioned air within a room.

The invention also aims to propose a ceiling assembly to precisely control the diffusion of air at the periphery of the room.

The invention also aims to propose a ceiling assembly avoiding any device to be visible, and in particular grilles, while ensuring the circulation of air within the room concerned, the circulation of air being related to the air conditioning or ventilation of the room concerned.

For this purpose, and according to a first aspect, the invention proposes a hanger profile for canvas for the implementation of a stretched ceiling in a room to be conditioned, the hanger profile comprising at least two wings connected together by a connecting side, one of the wings being arranged to allow the fixing of the hanger profile on a wall of the room to be conditioned, said profile being characterized in that it comprises at least one opening allowing the passage of air through said profile.

According to another aspect, a second wing of the profile is provided with a locking end of a hook to a canvas, the connecting side and the hanger wing being arranged to define together an unobstructed airflow slot through the profile and bounded on the one hand by the locking end of the hook of the hanger wing, the profile including at least one opening allowing the though passage to air through said profile from or in the direction of the slot.

Advantageously, on the other hand, the air passage slot is delimited by the wall or the profile fixing wing.

The configuration of the profile according to this invention thus makes it possible to define, along the entire length of the wall, an open air passage slot between the plenum and the room, without any obstruction or impediment to the passage of air, unlike the prior art mentioned above. The planned openings on the hanger wing and/or the connecting side of the profile according to this invention, which may each represent an open surface area of several square centimetres (e.g. 4 $cm^2$) with a spacing of less than 1 cm from one another, can form, for one meter of profile according to the invention, a cumulated open surface area of several hundred square centimetres, thus providing maximum air circulation.

In addition, openings are provided on the profile according to the invention on the hanger wing, which is inclined, and on the connecting side which extends horizontally between the room and the plenum, thus facilitating air circulation between the room and the plenum.

Advantageously, one of the wings, which is the hanger wing for canvas, converges towards the fixing wing for the hanger profile or the wall to which the hanger profile is fixed. According on a particular configuration, the hanger wing for canvas is arranged to have an angle with respect to the other wing of less than 90 degrees, and preferably between 30 and 50 degrees.

Advantageously, the passage opening(s) is (are) provided on the hanger wing for canvas or on the connecting side. According to an alternative design, it may also be possible for both the canvas fixing wing and the connection side to have at least one through opening.

The advantage of such an arrangement of the hanger profile (positioning of the through openings on the canvas hanger wing and/or the connection side converging toward the hanger profile) is to prevent the through opening which opens toward the slab from being visible from the room when the stretch ceiling is in place.

Advantageously, the canvas hooking wing is provided with a plate allowing a separation wall to be supported.

Advantageously, the wings are arranged to define a slot communicating with the through opening, said slot being delimited by the fixing wing of the profile on the wall or by the wall itself when the hanger profile is fixed on said wall and on the canvas hooking wing.

Advantageously, the hanger profile has a deflector provided in the slot that is arranged to deflect the air flow through the profile towards the through opening or the slot as air enters either through the slot or through the opening.

Ideally, the profile according to the invention is formed by the association of two distinct parts joined together, the first part forming a profile, one branch of which forming the fastening wing, the second part forming a profile equipped with a means for joining the first part and at least one means for fastening a canvas.

In this case, the fastening means is in the form of an internal groove for receiving the end of a branch of the first part of the profile, provided in the thickness of the second part of the profile.

Advantageously, one or the other of the profile construction variants according to the invention can be equipped with at least one cover for closing an opening through which air can pass. These covers are inserts that can be positioned on certain openings of the profile to limit air circulation at this location, for example to protect a decorative element such as a work of art positioned at that location of the wall.

As will be readily understood upon reading the detailed description of non limiting examples of embodiments, the hanger profile according to the invention has the following advantages:

to allow for simultaneously blowing and drawing in air to free oneself from the air grilles of the prior art systems to control the diffusion of air in the room not to see what is located above the peripheral slot to allow easy mounting of the stretch ceiling to allow the association of any equipment for ventilation and air conditioning (heating, cooling, dehumidification, humidification).

The invention also concerns a ceiling assembly allowing air to be circulated in a room to be conditioned, the ceiling assembly including at least a stretch ceiling defining with the upper tile of the room to be conditioned underneath which a plenum is mounted, the stretched ceiling comprising at least one stretched canvas extending between the walls of the room to be conditioned 1 and fixed to these by means of hanger profiles, at least one of the hanger profiles being a hanger profile as described above in order to allow air to pass between the plenum and the room.

Advantageously, the wings of the hanger profile are arranged to define a slot communicating with the through opening and oriented so that air flows out of the plenum along the wall to which said profile is fastened. The air blown along the vertical walls equipped with a hanger profile allowing the passage of air will allow the walls to be tempered, thus reducing the temperature difference between these walls and the ambient air.

Advantageously, the plenum has a first and a second space separated by a partition lining, one of the spaces defining a plenum space for air entering into the room, the other space defining a plenum space for air exiting from the room.

Advantageously, the ceiling assembly includes a plenum delimited by a tensioned ceiling mounted in a room adjacent to the room to be conditioned and the upper slab of the adjacent room, said plenum being separated from the plenum of the room to be conditioned by a partition traversed by at least one duct allowing fluid communication between the two plenums.

Advantageously, the ceiling assembly is equipped with a ventilation system and/or an air conditioning system fluidically connected, at least at the inlet side, to the plenum of the room to be conditioned.

Advantageously, the air conditioning system is housed in the plenum of the adjacent room.

The ceiling assembly and hanger profiles according to the invention offer the possibility to implement, according to a first configuration, the blowing and suction of air within the same room, and therefore in the same volume and, according to a second configuration, the blowing of air in the room to be conditioned (ventilation and/or air conditioning) and the suction of air in an adjacent room.

In the case where the blowing and suction of air are implemented in the same room, the plenum between the upper slab and the stretched ceiling will be advantageously separated into two separate volumes and sealed from one another. This separation can be achieved in two ways: either by means of a "conventional" separation profile supported on a vertical partition wall, the stretched ceiling will then be equipped with a "separator" at the level of the separation profile, or by means of a special profile of the hanger profile (profile with a plate for fixing a vertical separating wall). In the latter case, there is no need to install a separator on the stretched ceiling.

The ceiling assembly and the hanger profiles according to the invention therefore make it possible to deal with the following three cases:

air-conditioned and/or ventilated room with air intake in an adjacent room, air-conditioned and/or ventilated room with blowing and suction of air within the same room and implementation of a separator at the level of the stretched ceiling, air-conditioned and/or ventilated room with blowing and suction of air in the same room and use of the special suction profile.

The ceiling assembly thus created with the hanger profiles according to the invention makes it possible to do without any air blowing or suction grilles so that the aesthetics of the room is improved.

Furthermore, during the use of a system of heating or air conditioning, some of the power will be transmitted by radiation (hot or cold) from the ceiling, the rest by the flow of air blown through the profiles (at the periphery of the room), thus generating an excellent thermal comfort for the occupants.

BRIEF DESCRIPTION OF THE DRAWINGS

Other objects and benefits of the invention will appear in the description that follows, with reference to the attached drawings, in which.

a top view (FIG. 20*a*)

a bottom view (FIG. 20*b*)

a front three-quarter perspective view (FIG. 20*c*)

a side view (FIG. 20*d*)

FIG. 21*a*) to 21*d*) represent a second embodiment of a cover for the openings of a hanger profile according to the invention with, respectively:

a top view (FIG. 21*a*)

a bottom view (FIG. 21*b*)

a front three-quarter perspective view (FIG. 21*c*)

a side view (FIG. 21*d*)

Figure 19:
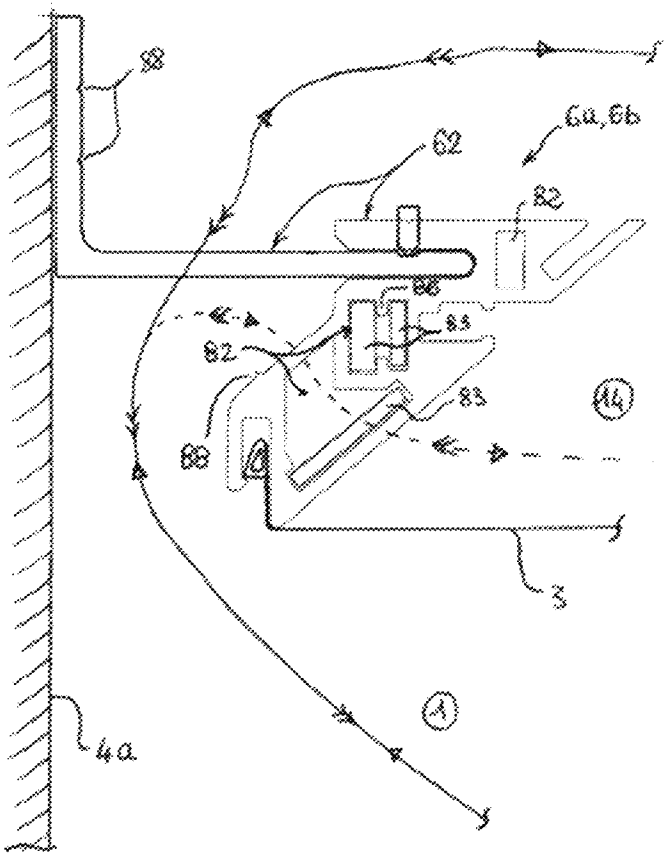
FIG. 19 shows a schematic cross-sectional view of a two-part hanger profile according to a second embodiment, mounted on a wall, supporting a canvas and equipped with internal brackets for fixing functional elements.

FIG. 22 represents an alternative embodiment of the hanger profile of FIG. 19.

For greater clarity, the same or similar elements of the different embodiments are marked by identical references on all the figures.

DETAILED DESCRIPTION

Figure 1:
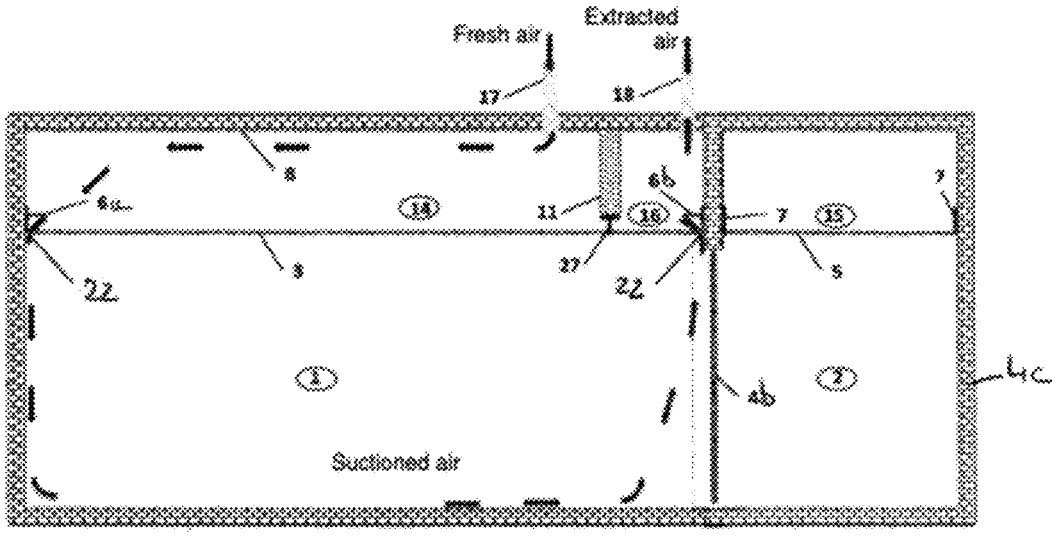
FIG. 1 represents a schematic view of a ceiling assembly according to a first embodiment of the invention.

FIG. 1 illustrates a schematic view of a ceiling assembly allowing the air to flow within a room to be conditioned 1. "Room to be conditioned" means a room intended to receive fresh air or to be conditioned according to the system used (ventilation system as illustrated in FIG. 1 or air conditioning system).

In the illustrated embodiment, the ceiling assembly uses a stretched ceiling (or false ceiling) inside the room to be conditioned 1, formed by a stretched canvas 3 extending between the walls 4*a*, 4*b* of the room to be conditioned 1 and fixed to them via hanger profiles and delimiting, with the upper slab 8, a plenum 14 and a plenum 16 separated in a sealed manner by a lining 11 with a separation profile 27.

In order to allow air to circulate in the room, two of the room walls are provided with hanger profiles arranged to allow air to pass between plenums 14 and 16 and the room to be conditioned 1. Depending on whether they allow the passage of fresh air or the suction of air, we will speak of blowing profile 6*a* and suction profile 6*b*. However, these profiles are identical. Examples of blowing/suction profiles will be described below.

As shown in FIG. 1, suction profiles 6*b* are attached to the walls opposite the walls provided with blowing profiles 6*a*. This has the advantage of obtaining an optimal air sweep of the room to be conditioned 1.

The ceiling assembly also comprises a vertical separation lining 11 arranged in the plenum 14 to define two spaces, one defining a plenum space for the entry of air into the room, the other defining a plenum space for the exit of air from the room. In the following, the blowing plenum 14 will be that in which fresh air is received and the suction plenum 16 will be that in which the air aspirated from the room to be conditioned 1 is received.

In order to ensure a separation between the two spaces, the separation lining 11 is attached by its lower part to a separation profile 27 joining the stretch ceiling as depicted on FIG. 1.

The blowing plenum 14 is equipped with an air duct 17 for blowing fresh air, said duct passing through the part of the upper slab 8 delimiting the blowing plenum. Similarly, the suction plenum 16 is equipped with an air duct 18 for the intake of air, said duct passing through the part of the upper slab delimiting the suction plenum.

Figure 2:
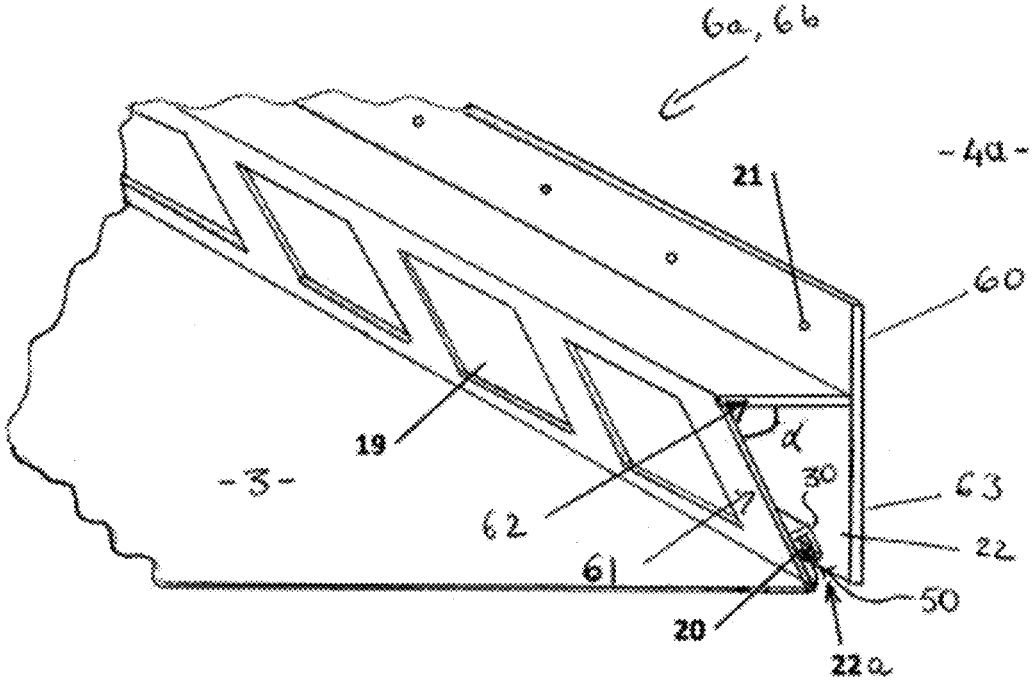
FIG. 2 shows a perspective view of a fastening profile according to a first embodiment of the invention implemented in the fastening assembly of FIG. 1.

FIG. 2 shows an example of embodiment of a blowing and suction profile 6*a*, 6*b* allowing the passage of air between the room to be conditioned 1 and the associated plenums 14 and 16 and implemented in the ceiling assembly of FIG. 1.

The blowing and suction profile 6*a*, 6*b* has a first vertical wing 60 and a second vertical wing 61 connected to one another by a horizontal connecting lining 62.

The first wing defines a fastening wing 60 allowing the profile to be fastened to the wall. In order to do this, the fastening wing has holes 21 for the passage of fastening means such as screws, rivets or similar. In the embodiment shown, the fastening wing 60 extends from the connection lining (i.e. upwards). It is extended in its lower part by a third vertical wing 63.

The second wing defines a hanger wing 61 allowing canvas to be hooked. The hanger wing converges towards the third wing. Advantageously, the hanger wing has an angle in relation to the third wing between 30 and 50 degrees, and preferably of 45 degrees. According to FIG. 2, this hanger wing 61 has on its inner wall directed towards the wall, a hanger means 30 for a canvas hook 50, configured to place the canvas hook at a distance from the wall along which it runs so as to define a slot for the passage of air. The hanger means 30 thus places the canvas hook along the lower edge of the hanger wall 61, leaving an air gap between the hook and the wall (or the third vertical wing 63). For example, the distance separating the hook from the hanger means 30 can be between 0.5 and 5 cm, preferably between 1.5 and 3 cm and still preferably around 2 cm. Ideally, as for the examples shown, the canvas hook can be elastically deformable, and the hanger means 30, can have the shape of a C-shaped hook in cross-sectional view, curved towards the inner side of the hanger lining 61 so as to form with this inner side a grooved passage for the elastically deformed hook, leading to a hook receiving groove in its undistorted configuration and a hook locking edge within the groove and kept at a distance from the wall 4*a* by the hanger lining 61 to allow air to pass through.

Thus, as shown, the hanger wing defines with the third wing a slot 22 with a through opening 22*a* with an opening axis substantially parallel to the wing fastened to the wall. This makes it possible to ensure an air supply at the inlet of the room along the wall on which the blowing profile is fixed and at the outlet of the room (and therefore at the inlet of the plenum) and an air suction with a trajectory substantially tangential to the wall carrying the suction profile. The slot allows, with the openings in the fastening wing, the passage of air between the plenum and the room.

The blowing and suction profiles 6*a*, 6*b* have through openings 19 for the air to pass between the plenum and the room. In the embodiment shown, the openings are rectangular windows aligned along the hanger wing. This is of course one example of embodiment, the openings can present another form and/or be arranged in a different way. Furthermore, the number of openings is variable and a single opening or several openings may be provided. There may also be no opening, the profile so configured then becoming a "conventional" profile 7 for hanging the stretched ceiling.

Advantageously, hanger profiles 6*a*, 6*b* are available in different calibres, these calibres offering different widths of slot 22 located in the lower part of the profile and therefore different sections of openings 22*a*. The use of blowing profiles in different calibres thus allows for perfect speed control of the air blown at the periphery of the walls equipped with these profiles. The air speed is calculated as a function of the flow rate of the blown air, it is determined so as to obtain a sufficient range of the air blown in order to reach the bottom of the vertical wall while respecting very weak velocities of air as perceived by the occupants of the room and thus ensure optimal comfort. In the same way, the use of suction profiles of different calibres makes it possible to control the speed of suction in order to ensure optimal air sweeping.

Figure 8:
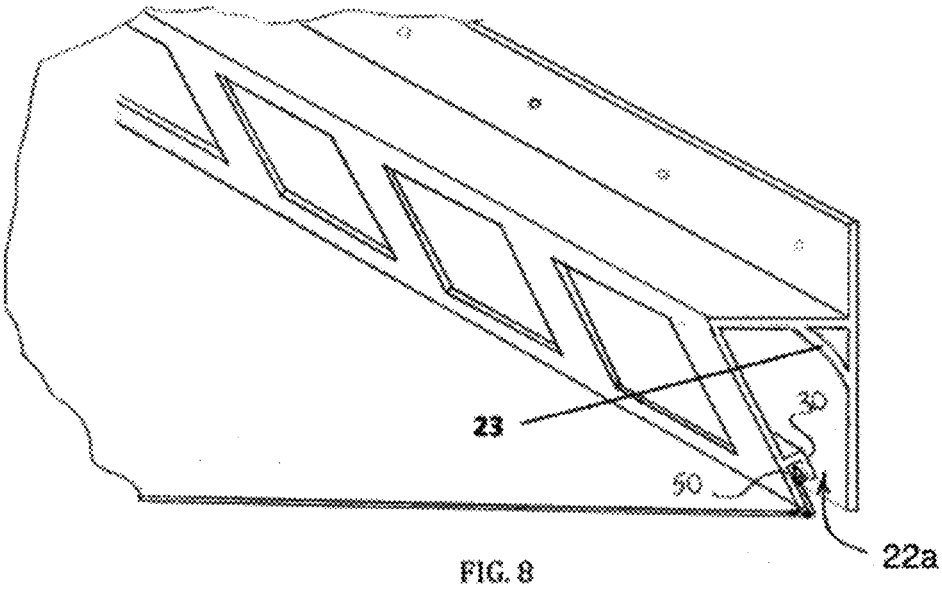
FIG. 8 represents a perspective view of a hanger profile according to a second embodiment of the invention.

Advantageously, the blowing and suction profiles 6*a*, 6*b* have a deflector 23 (FIG. 8) to deflect the air flow towards the through openings or the slot depending on whether the air enters through the slot or the through openings. The presence of a deflector has the advantage of improving the air flow by minimizing the air flow resistance and therefore the air pressure losses of the profiles. In the embodiment shown in FIG. 8, the deflector connects the connection lining to the third wing. The deflector can be of any shape (straight, curved, etc.), the optimal shape however being a circular arc, as shown in FIG. 8.

Fresh air is blown via the blowing duct through the upper slab into the blowing plenum, then to pass through the blowing profile. At the outlet of the blowing profile, due to the orientation of slot 22, fresh air flows along the wall equipped with the profile.

The air sucked in is drawn towards the stretched ceiling along a path substantially tangential to the wall provided with the suction profile to pass through it. The sucked-in air is then extracted from the blowing plenum via the extraction duct.

Adjacent room 2 is represented equipped with a stretched ceiling. It is of course obvious that this one could not be equipped with a ceiling, the adjacent room not contributing to the flow of air in the room to be conditioned, unlike the ceiling assemblies illustrated on FIGS. 3 to 7, 11 and 12.

Figure 3:
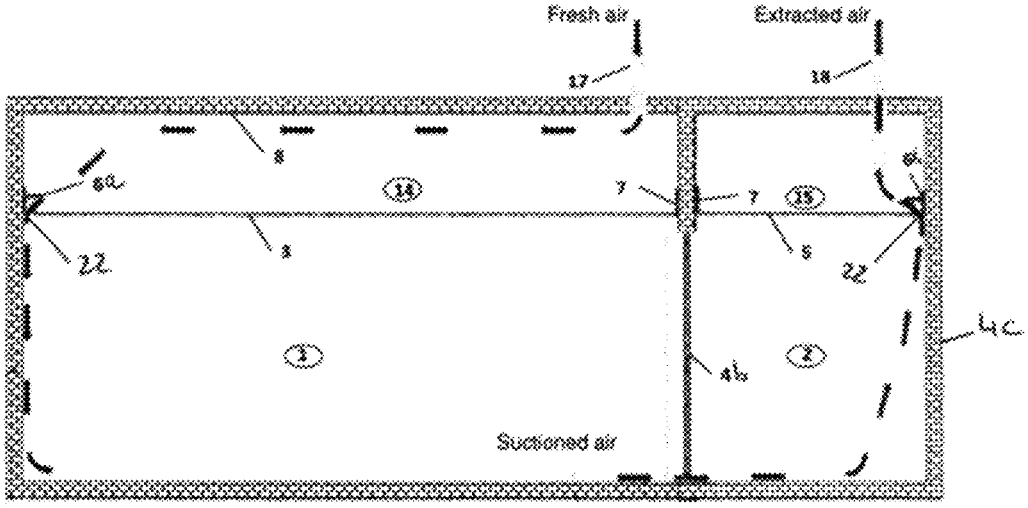
FIGS. 3 to 7 represent respectively various embodiments of a ceiling assembly using a hanger profile from FIG. 2.

FIG. 3 represents a particular embodiment in which fresh air is blown in the room to be conditioned 1 and the air suction is carried out in an adjacent room 2.

The room to be conditioned 1 is equipped with a stretched ceiling 3 delimiting a plenum with the upper slab. The stretch ceiling hangs from the walls 4*a*, 4*b* of the room via hanger profiles. In the embodiment shown, only one of the walls, the furthest away in the example (wall 4*a*), is equipped with profiles allowing air to pass through, the remaining walls being equipped with conventional hanging profiles 7 (i.e. not being arranged to allow air to pass through), these profiles 7 can also be made using profiles 6*a*/6*b* not equipped with openings 19 for the passage of air on wing 61. In the example shown, the profile is a blowing profile 6*a*.

Similarly, adjacent room 2 is equipped with a stretched ceiling 5 delimiting a plenum 15 with the upper slab. The stretched ceiling is hung on the walls of the adjacent room via hanger profiles, at least one of the hanger profiles being a suction profile 6*b*. If all the walls are not equipped with 6*b* suction profiles, the remaining walls can be equipped with conventional profiles 7 for hanging a stretched ceiling. In the example shown, only one wall, here the furthest away from the room to be conditioned (wall 4*c*), is equipped with suction profiles.

Plenum 14 of the room to be conditioned 1 forms the blowing plenum while plenum 15 of the adjacent room 2 forms the suction plenum.

In the embodiment shown, the air sucked in passes between the volume of the conditioned room 1 and the volume of the adjacent room 2 via an existing or created gap between the 2 rooms, for example a void under door 4 separating the 2 rooms. The air aspirated then joins plenum 15 through the peripheral suction slot 22 generated by installing suction profiles 6*b*.

The air aspirated will then be extracted from the plenum of the adjacent room via an air duct 18 through the upper slab from the plenum of the adjacent room.

Figure 4:
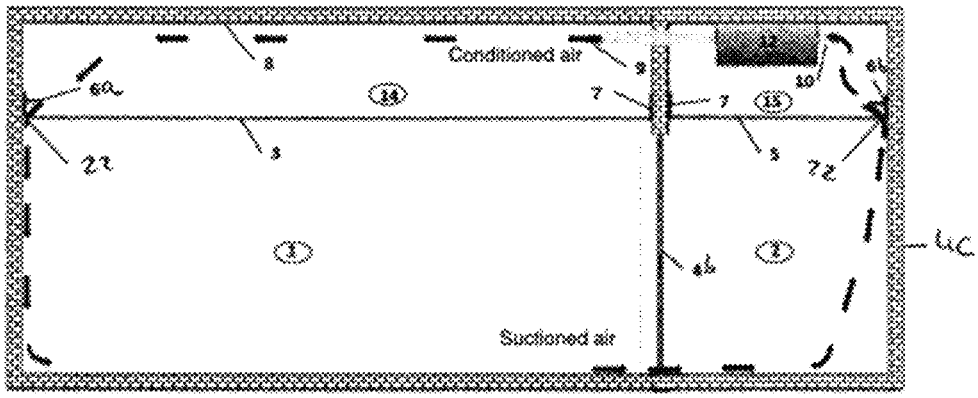
Figure 5:
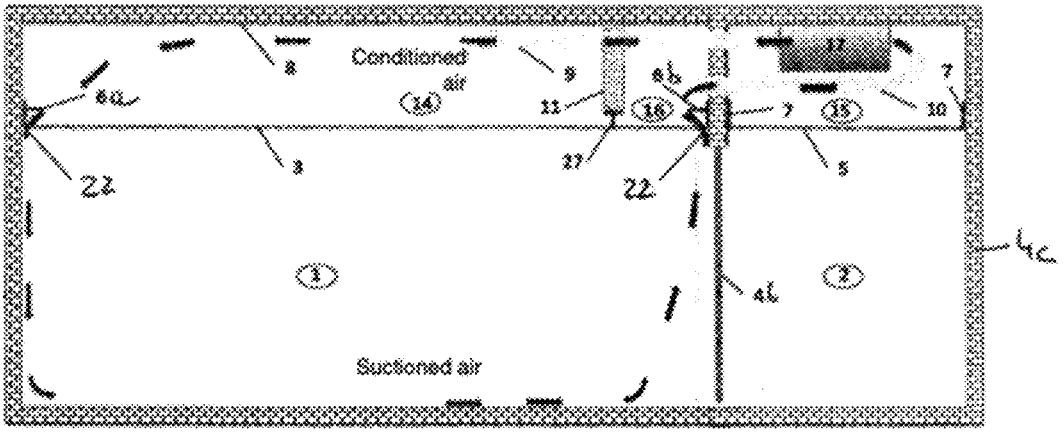
Figure 6:
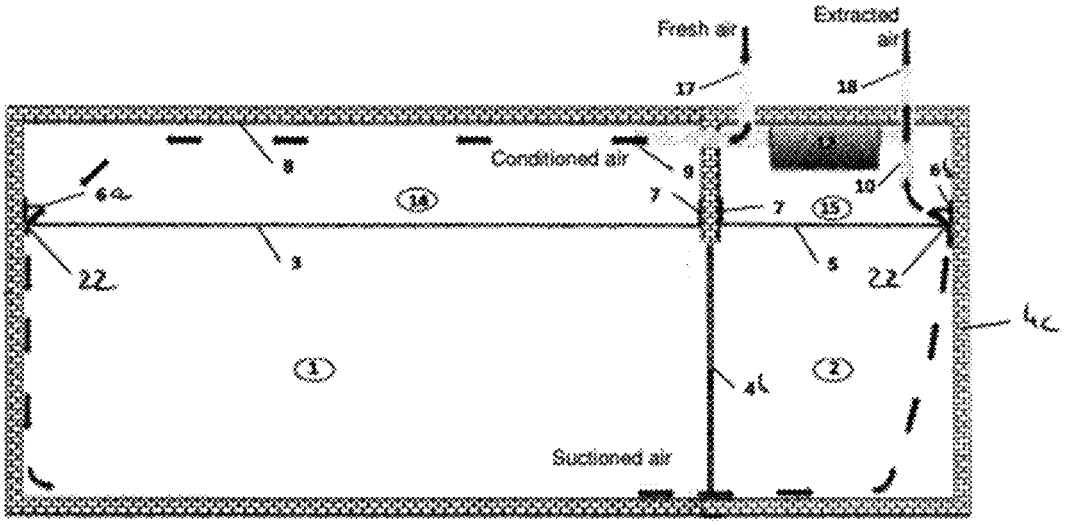
Figure 7:
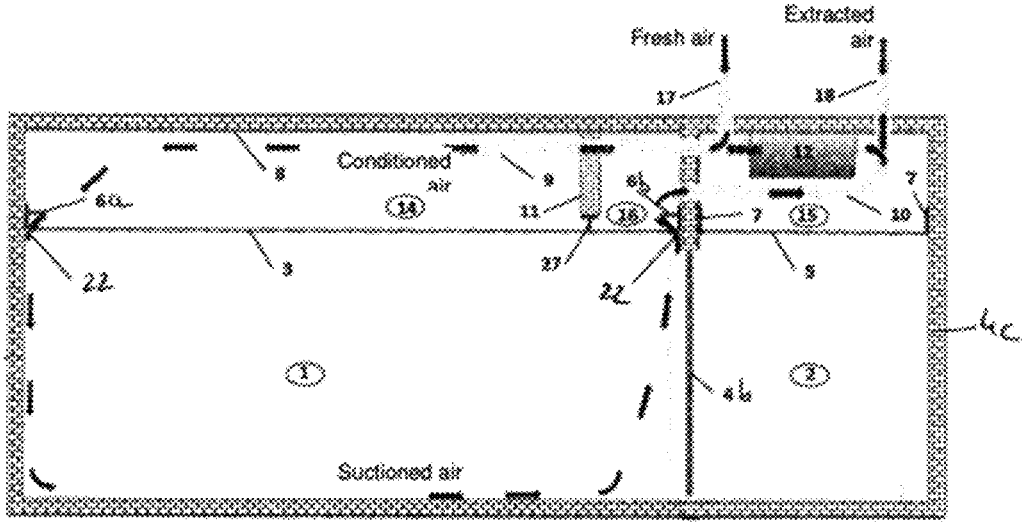

FIG. 4 represents another embodiment in which the circulated air is conditioned air from an air conditioning equipment 12 located in the adjacent room to the room to be conditioned 1.

The ceiling assembly follows the arrangement of the ceiling assembly in FIG. 3, in which the fresh air inlet duct and the exhaust air duct are replaced respectively by a blowing air duct 9 connected to the exit of the air conditioning equipment and by a suction air duct 10 connected to the inlet of the air conditioning equipment, the blowing duct passing through the wall separating the plenum of the room to be conditioned from the plenum of the adjacent room. As before, the plenum of the room to be conditioned forms the blowing plenum while the plenum of the adjacent room forms the suction plenum.

The conditioned air is blown into the plenum of the room to be conditioned by the air conditioning equipment via the blowing duct which passes through the blowing profile to run along the wall equipped with the profile. The air sucked in passes between the volume of the conditioned room 1 and the volume of the adjacent room 2 via a gap between the 2 rooms. The sucked air then reaches plenum 15 of the adjacent room through the peripheral suction slot 22 generated by the suction profile 6 where it reaches the air conditioning equipment via the suction air duct 10.

In some cases, however, it is not possible to generate a sufficient gap between the room to be conditioned 1 and the adjacent room 2 to convey the flow of aspirated air. This may be the case, for example, in premises that must provide acoustic insulation. The ceiling assembly shown in FIG. 5 helps to overcome this constraint. The implemented ceiling assembly has a similar arrangement to the ceiling assembly in FIG. 1. It also includes a suction air duct 15 passing through the partition separating the suction plenum of the room to be conditioned and the plenum of the adjacent room in which the air conditioning equipment is installed as well as a blowing air duct 9 through the partition separating the two rooms and the separation lining 11 separating the suction plenum and the blowing plenum of the room to be conditioned. In this case, the adjacent room is equipped with a stretched ceiling 5 fastened to the walls of the adjacent room via conventional hanger profiles 7 (i.e. not arranged to let the air through).

As in the ceiling assembly of FIG. 1, the aspirated air reaches the suction plenum 16 through the peripheral suction slot 22 generated by installing the associated suction profile 6. The aspirated air then reaches any air conditioning equipment by means of the suction air duct 10. The conditioned air is then recirculated via the blowing duct 9.

It may also be possible to connect the suction air duct 10 and the blowing air duct 9 respectively to an extraction/exhaust air duct 18 and a fresh air inlet duct 17 communicating with the outside of the adjacent room and the associated plenum (FIG. 6) so as to carry out both the air conditioning and ventilation of the room to be conditioned 1.

The ceiling assembly thus created makes it possible to condition a very tight room (for acoustic reasons, for example) in relation to its adjacent rooms 2.

Figure 9:
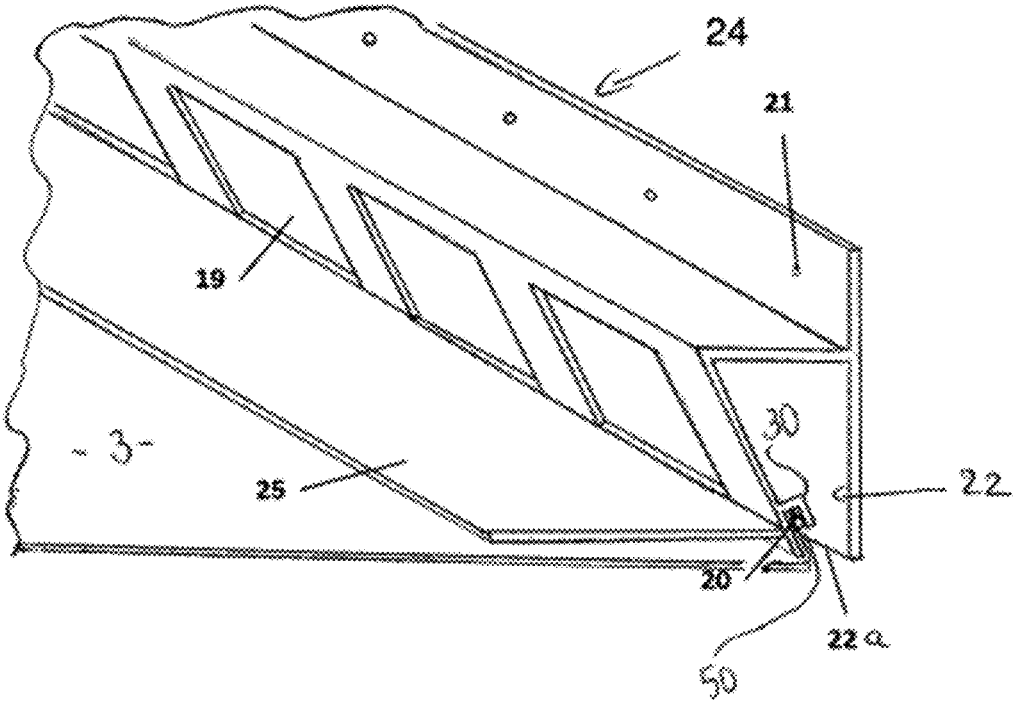
FIG. 9 represents a perspective view of a hanger profile according to another embodiment of the invention.
Figure 10:
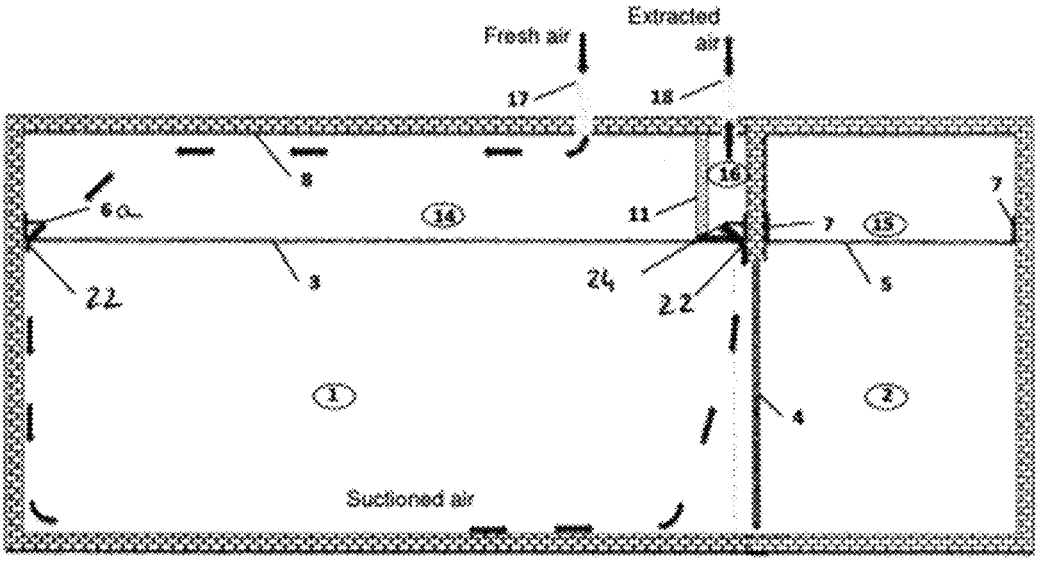
FIGS. 10 to 12 represent various embodiments of a ceiling assembly using the hanger profile of FIG. 9.
Figure 11:
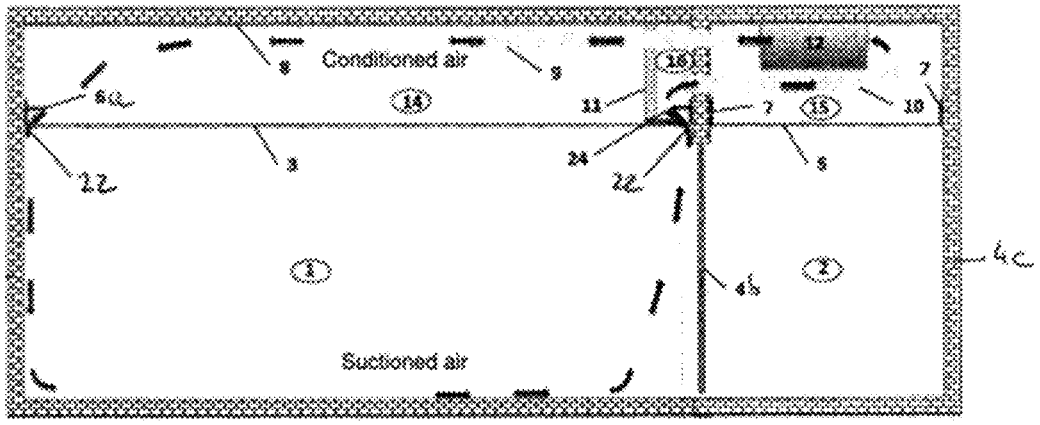
Figure 12:
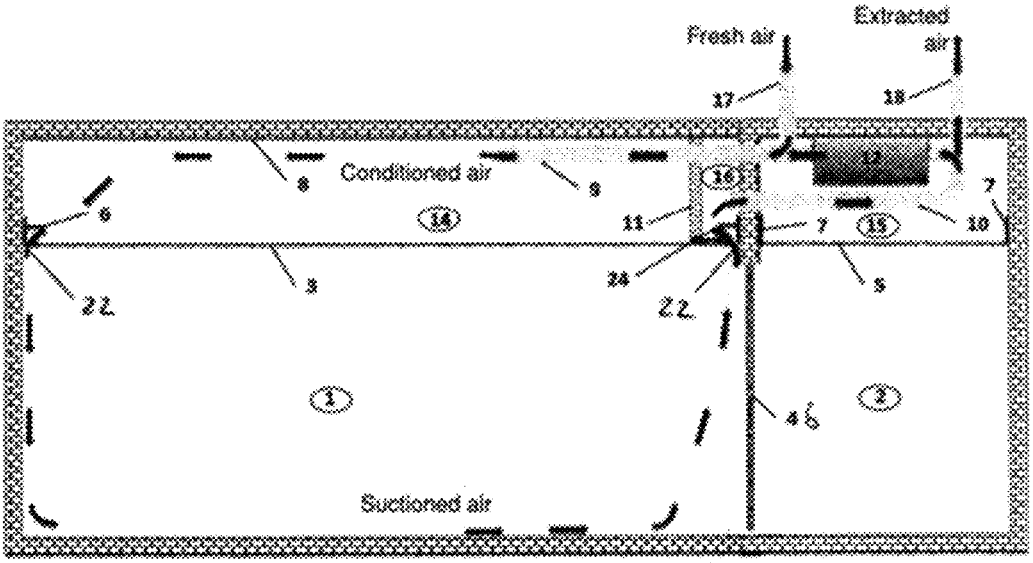

FIG. 9 illustrates an alternative embodiment of the hanger profile according to the invention. In this alternative embodiment, the hanger profile 24 has the same shape as the profile in FIG. 2 except that it also has a horizontal plate 25 extending under the through openings in an opposite direction to the third wing. The function of the plate is to support a vertical partition lining without having to install a visible separator on the stretched ceiling, as shown in FIGS. 10 to 12. This improves the aesthetic appearance of the stretched ceiling while ensuring air circulation within the room.

As shown in FIGS. 10 to 12, the suction profiles 24 are fastened to the walls opposite to the walls bearing the blowing profiles. This has the advantage of obtaining an optimal air sweep of the room to be conditioned 1.

The plate 25 can be advantageously provided with an upward element at its extremity or with any element allowing the fastening of the vertical separation lining.

Figure 13:
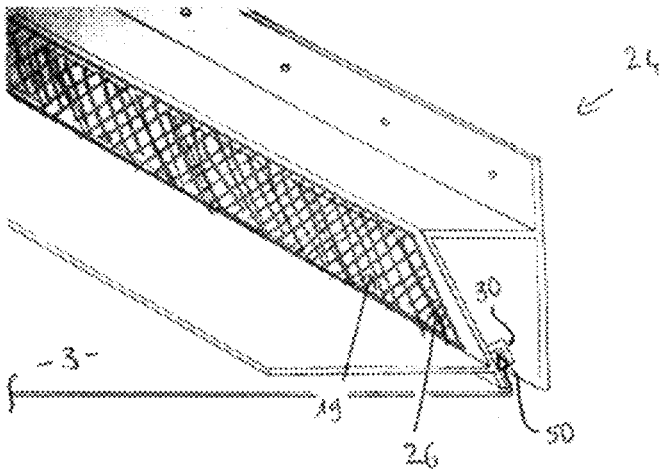
FIG. 13 shows the hanger profile from FIG. 9 provided with a protective mesh.

Advantageously, blowing and suction profiles 6*a*, 6*b*, 24 can be equipped with a mesh positioned over the openings 19 in order to cover them. The presence of a mesh thus prevents any impurity or any insect from gaining access to the plenum 14, 15, 16 located between the upper slab and the stretched ceiling. For example, the suction and blowing profile 24 is illustrated with such a filter 26 (FIG. 13).

Figure 14:
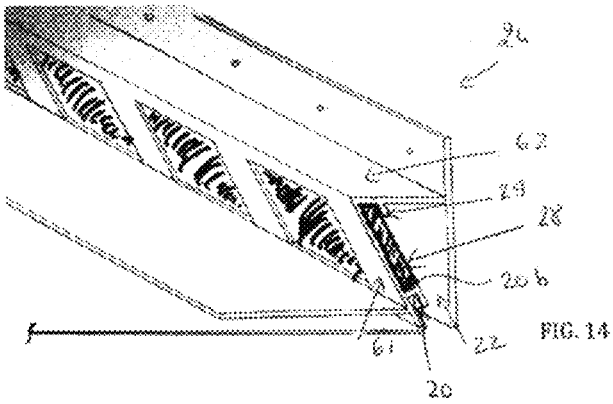
FIG. 14 shows a perspective view of a hanger profile provided with a filter.

According to a particular alternative embodiment, the profiles intended for suction 6*b*, 24 may be provided with a filter. This filter will then be able to replace filters present in the ventilation and/or air conditioning machinery connected to the system. Advantageously, the filter can be removed to allow its replacement or its cleaning. FIG. 14 shows a possibility of integrating such a filter into a suction profile of the type of profile 24. In the embodiment shown, filter 28 is held against the inside face of the hanger wing 61, installed on the stop 20*b* delimiting the canvas hanger groove 20, and is retained by a longitudinal strip 28 carried by the inner face of the connecting lining 62. By "inner face", it is meant the faces oriented towards slot 22.

It is of course obvious that the hanger profiles are not limited to those described above and that other configurations can be provided without departing from the invention. In particular, a profile without a third wing may be provided. In this case, the slot will be delimited by the canvas hanger wing and the wall on which the profile is fastened. Similarly, the third wing may be the fastening wing.

Figure 15:
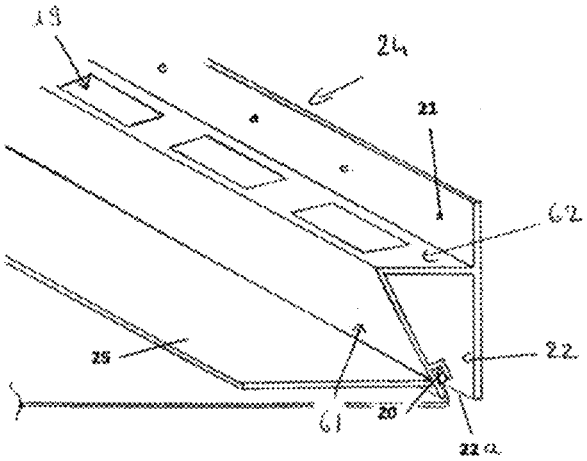
FIG. 15 represents a perspective view of a hanger profile according to another embodiment.

Similarly, in the embodiments previously described, the through openings 19 are carried by the canvas fastening wing 61. According to another embodiment, the through openings 19 may be provided not in the fastening wing, but in the connection lining 62. For example, the profile in FIG. 9 is illustrated with such a positioning of the through openings 19 (FIG. 15).

The ceiling assembly is compatible with any air conditioning and/or ventilation technology. Air conditioning and/or ventilation equipment can be placed in the plenum 14 located above room to be conditioned 1, in the plenum 15 of any adjacent room to the room to be conditioned 1 but also in any other location of the building. In a general way, the installation of equipment outside the volume of the room to be conditioned 1 will be favoured, notably so as to avoid any acoustic inconvenience due to the operation of the machinery.

Regardless of the air conditioning and/or ventilation possibilities of the room, the invention allows the implementation of any type of stretch ceiling (conventional, acoustic . . . ) and allows the use of any process compatible with stretch ceilings, for example backlighting systems, sound systems, etc. In addition, a LED-strip light system could be installed in the corner between wing 61 and connecting lining 62, thus providing peripheral lighting for the room without the LED-strip being visible.

In general, within the room to be conditioned, at least one wall will be equipped with a blowing profile. It will be possible to choose the walls equipped with blowing profiles 6 and therefore to choose the walls along which the conditioned air and/or fresh air is blown. The other walls can be equipped with conventional profiles 7 for hanging the stretched ceiling. This choice allows the thermal comfort of the room to be optimized. In particular, it will be chosen, for example, to blow air along the external walls of the room, which are generally colder than the ambient air during winter and warmer than the ambient air in the summer.

Figure 16:
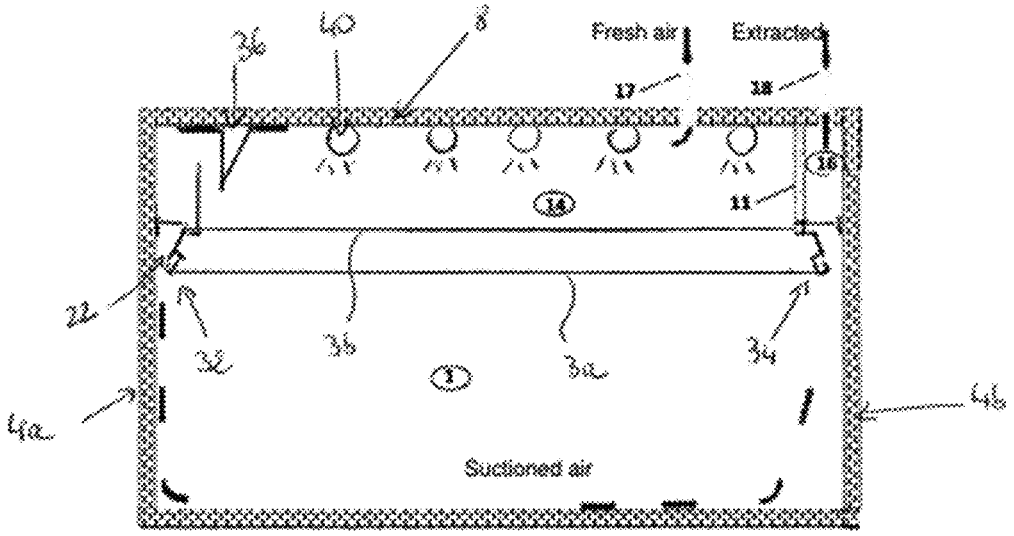
FIG. 16 represents a schematic view of a ceiling assembly using another hanger profile according to the invention.

FIG. 16 illustrates another embodiment of a ceiling assembly, the latter comprising light means 40 fixed on the upper slab 8.

Figure 17:
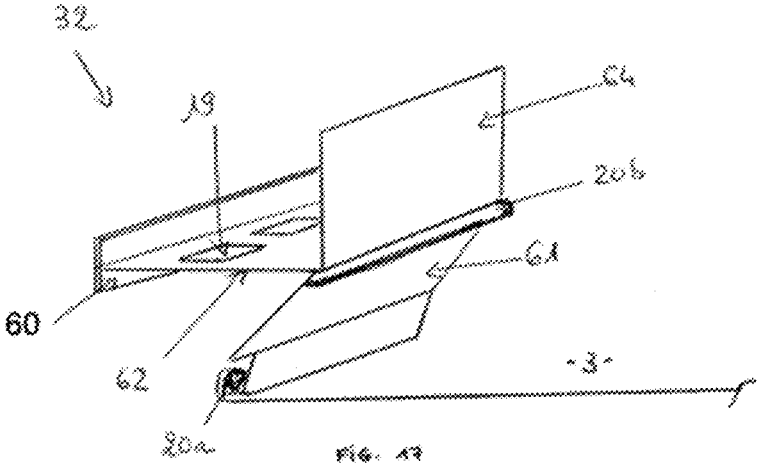
FIG. 17 represents a view in perspective of the hanger profile implemented in the ceiling assembly of FIG. 16.

The ceiling assembly shown here is a stretch ceiling formed by two stretched canvases 3*a*, 3*b* extending between the walls 4*a*, 4*b* of the room to be conditioned. The said canvases 3*a*, 3*b*, arranged parallel to each other, are fastened to the walls by means of two hanger profiles 32, 34, one constituting a blowing profile 32, the other constituting a suction profile 34. An enlarged view of the blowing profile 32 is shown in FIG. 17.

As in the embodiments of the hanger profiles previously described, the blowing profile 32 includes a fastening wing 60 connected a the canvas fastening wing 61 by a connection lining 62. As illustrated on FIG. 17, said wings 60, 61 are arranged so that, when the blowing profile 32 is fastened on wall 4*a*, fastening wing 61 forms an angle with the connection lining converging towards the wall 4*a*. Fastening wing 61 includes two hanger grooves 20*a*, 20*b* for said canvases 3*a*, 3*b*. One of the grooves is provided in the upper part of the fastening wing 61 with an opening on the inside of the profile, the other groove being provided at the bottom of the fastening wing 61. The through openings 19 for the passage of air between plenum 14 located above of the upper stretched canvas 3*b* are carried by the connection lining 62.

The blowing profile 32 also has a vertical wing 64 extending from connection lining 62, parallel to fastening wing 60, in an opposite direction to the fastening wing 61. In the embodiment shown, the vertical wing 64 is provided at the extremity of the connection lining 62. The function of this vertical wing 64 is to prevent the diffusion of light from the lighting means 40 via the through openings 19 and the through slot 22. In the following, this will be called the blocking wing 64 (or shield-forming wing).

In order to avoid any shadows on the canvas, the ceiling assembly has a substantially V-shaped profile 36 fastened to the upper slab 8 of the room, in the vicinity of the hanger profile 32, as shown in FIG. 16. In particular, profile 36 is arranged in relation to hanger profile 32 in such a way as to leave sufficient space between the blocking wing 64 and the profile 36 to allow air to pass through from the fresh air supply duct 17.

In the embodiment shown, the hanger profile 32 and the profile 36 are two separate and independent parts. However, these two profiles can, according to an alternative embodiment, form a single part. In this case, the blocking wing 64 would also include, like the connecting lining 62, through openings to allow air circulation.

The suction profile 34 has all the characteristics of the blowing profile 32, except that it has no blocking wing. The diffusion of light is blocked in the ceiling assembly shown on FIG. 16, by the separation lining 11 of the blowing plenum 14 and the suction plenum 16 of the room. Obviously, a suction profile 34 identical to the blowing profile 42 can also be provided without departing from the scope of the invention.

As a complement to or in replacement for the lighting means 40 provided in plenum 14 of the ceiling assembly, lighting means may be provided fixed in the upper part of the hanger profile according to the invention, preferably on the side of the blocking wing 64 facing the walls 4*a*, 4*b* so as to provide lighting at the periphery of the room or the frame. In this case, suction profiles 34 with blocking wings 64 will preferably be provided.

According to a particular embodiment not illustrated, it may also be possible to position a loudspeaker or other sound broadcasting equipment in the vicinity of the through openings 19 to ensure efficient sound transmission.

Figure 18:
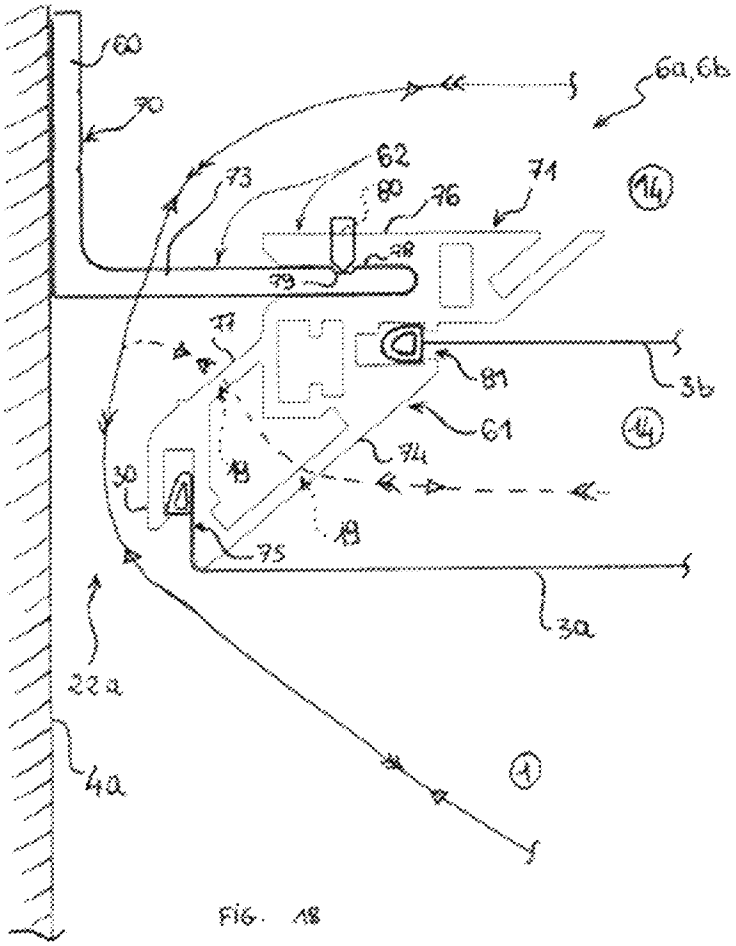
FIG. 18 represents a schematic cross-sectional view of a hanger profile made of two parts according to a first embodiment, mounted on a wall and supporting two canvases.

According to another advantageous embodiment, shown in FIGS. 18 and 19, the blowing and suction profiles 6*a*, 6*b* can be two independent parts 70, 71 to be fixed to each other.

In the example shown, the first profile part 70 is the fastening wing 60 and partially the horizontal connecting lining 62, and the second profile part 71 is the remaining part of the horizontal connecting lining 62 and the inclined hanger wing 61.

The first part of profile 70 is defined in a particularly simple form: that of a longitudinal profile with an L-shaped cross-section, the vertical branch of which constitutes the fastening wing 60 and the horizontal branch 73 constitutes a portion of the horizontal connecting lining 62.

For the purpose of air circulation, the horizontal branch of the L-shaped profile will be provided with an opening 19 for the passage of air.

The second part of profile 71 is slightly more complex and shows the general form of a longitudinal profile with a trapezoidal cross-section, including the long base 74, the short base 77 and the lateral side 75 interposed between them forms the inclined fastening wing 61, the opposite side 76 which is horizontal forming the remaining part of the horizontal connecting lining 62.

More precisely, as visible in FIG. 18, the second profile part includes a longitudinal groove 78 for receiving the end of the horizontal branch 73 of the L of the first profile part 70. An attached blocking means, such as a screw, can be provided to engage in an orifice 79 formed on the upper surface of the end of the horizontal branch of the L to block it, passing through the thickness of the upper lateral side of the second profile part. A mark 80 may be provided on the external surface of the upper lateral side 76 of the second profile part to correctly position the screw or other blocking means opposite to the orifice 79 prior to its insertion into it.

This second part of profile 71 comprises on the external surface of its lateral side 75 which is vertical, the aforementioned hook 30 allowing the passage in a deformed configuration, then the blocking in a resting configuration of an elastically deformable hook 50 to fasten the main stretched canvas 3*a*.

Advantageously, this second part of the profile 71 may include a second means of fastening an elastically deformable hook of a secondary stretched canvas 3*b*, as illustrated in FIG. 18. This second means of fastening 81 is for example provided in the form of a longitudinal groove partially closed by at least one hook retaining edge (two on the figure) of the second canvas, formed from the outer surface of the long base 74 of this second profile part, for example immediately under the receiving groove 78 of the end of the first profile part.

This second canvas 3*b* will be able to fulfil the function of collecting and retaining deposits caused by dust and/or insects in order to that these remain at a distance from the underlying main canvas and remain invisible from the room through the canvas when, for example, it is provided translucent.

The second part of the profile may comprise, in addition to different recesses 82 (identified on FIG. 19) arranged in the thickness of this second profile part, between the two hook locking grooves to house brackets or fixing sleeves 83 for functional elements arranged in the plenum, or simply to allow lightening the structure of this second part of the profile 70 to optimize the cost. Lugs 86 may be provided protruding from the lining forming these recesses to partition their space and accommodate several brackets or block them in their respective recesses.

At the extremity of the second profile part 71, forming the junction between the horizontal upper side and the inclined long base, an angled groove can be provided in the thickness of this second profile part parallel to the external surface, in order to hold and fasten a blocking wing or a shield «wing» as presented above.

For air circulation purposes, through openings 19 for the passage of air may be provided in this second profile part on the walls constituting the short and long bases in communication with each other.

Figure 20:
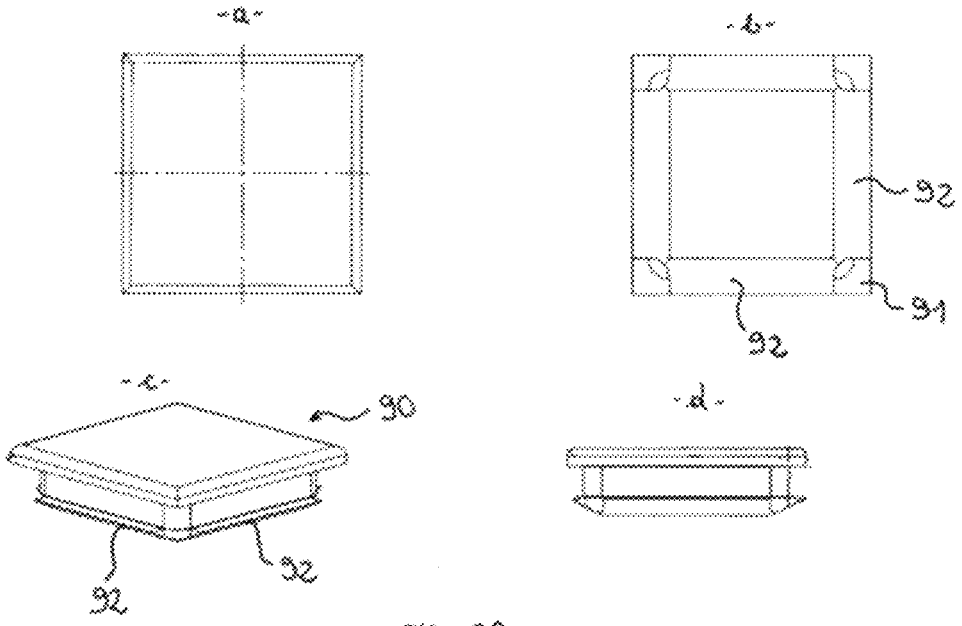
FIG. 20*a*) to 20*d*) represent a first embodiment of a cover for the openings of a hanger profile according to the invention with, respectively.
Figure 21:
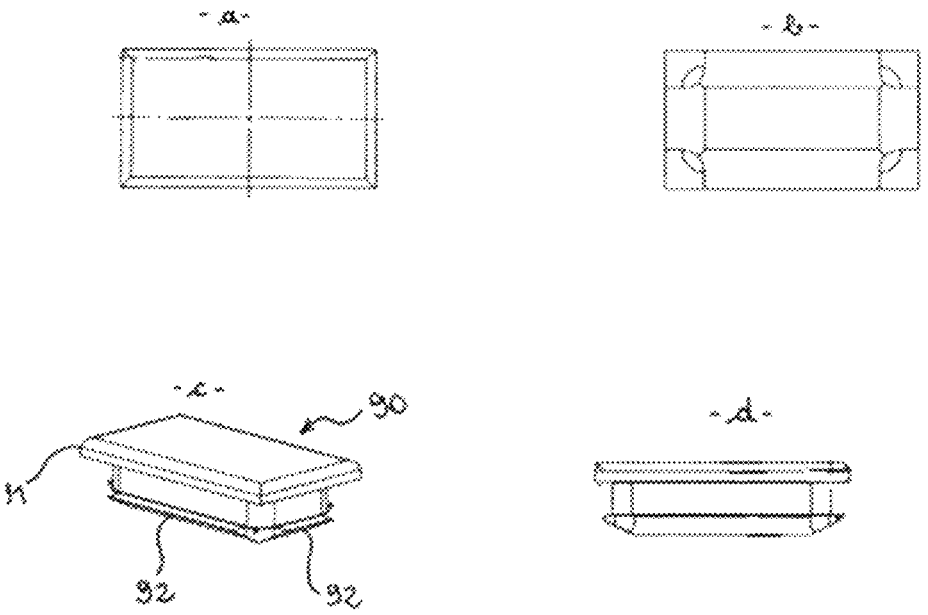
Figure 21:
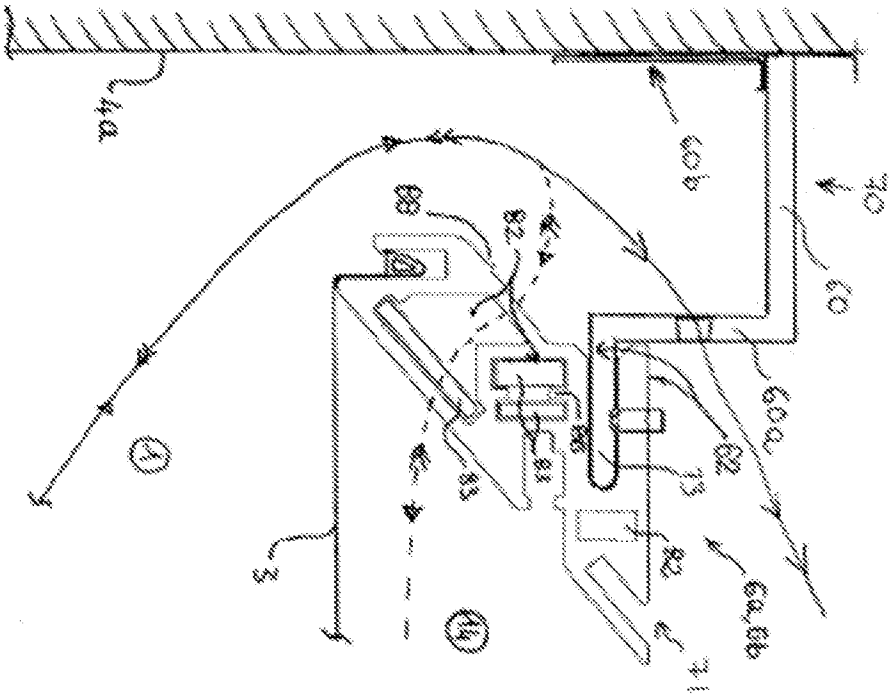

These openings, like those in the first part of the profile, can be closed if necessary, by covers provided for this purpose and illustrated in FIGS. 20, 21.

These covers 90 may be in the form of parallelepiped blocks, one upper face of which is provided with a lateral edge 91 intended to be applied against the contour of the opening 19 that the considered cover closes, and the lower face of which is provided with elastically deformable blades 92 that disappear as the opening passes and lock behind the contour that defines it. In the example shown, the elastic blades extend along the length of the lateral sides of the parallelepiped block, except at the corners of the block.

Visual marks 88 taking the form of excess thickness or longitudinal beads may be provided on the external areas of each profile part 70, 71 in order to easily and precisely connect two profile parts end to end if necessary.

The formation of the suction or blowing profile in two parts so defined is particularly clever because the second, more complex part 71 can be manufactured in large series with a single dimension, while the first part 70 of an extreme simplicity can be achieved with different dimensions, in particular concerning the length of the branch of the L to be fixed to the second profile part to adjust as needed, by a simple choice of L-profile available, the desired spacing between the wall and the edge of the canvas and thus the size of the slit and the air circulation.

Consequently, the L-shaped profile in FIG. 19 has a longer horizontal branch that places the edge of the main canvas 3 at a longer distance from the wall 4*a* than the edge of the main canvas 3 in the alternative embodiment of FIG. 18 where the horizontal branch of the L-shaped profile is shorter.

FIG. 22 shows an alternative embodiment to the blowing and suction profiles 6*a*, 6*b* of FIG. 19. In this alternative embodiment, the second part of profile 71 has the same characteristics as the one shown in FIGS. 18 and 19. On the other hand, the first part of the profile 70 no longer has an L-shaped section, but a right-angled Z-shaped section. More precisely, the first part of the profile 70 consists of two horizontal branches connected together by a vertical branch, said horizontal branches extending in two opposite directions. The upper horizontal branch, referenced 60, is the fastening wing. It is fastened to the wall 4*a* via a bracket 60*b*. The lower horizontal branch, referenced 73, constitutes a portion of the horizontal connection lining 62. In order to allow air circulation, the vertical connection branch, numbered 60*a*, is provided with a through opening 19 for the passage of air. As before, the opening(s) provided on the first part of the profile 70, like those of the second part of the profile 71, can be closed by covers if necessary, as described above.

The invention is described above by way of example. It is understood that the person skilled in the art is able to carry out different embodiments of the invention without departing from the scope of the invention.

The invention claimed is:

1. A canvas hanger profile for making a stretched ceiling in a room to be conditioned, the hanger profile comprising at least two wings connected together by a connecting lining, a first wing being arranged to allow fastening of the hanger profile on a wall of the room to be conditioned, a second wing, which constitutes a canvas hanger wing, being provided with a locking end configured to receive a canvas hook, wherein the connecting lining and the canvas hanger wing are arranged to define together a slot through the canvas hanger profile and are delimited by the locking end of the canvas hanger wing, the canvas hanger profile having at least one through opening arranged to allow air to pass through said canvas hanger profile from or towards the slot.

2. The hanger profile according to claim 1, wherein the canvas hanger wing converges in a direction of a third wing allowing fastening of the hanger profile onto a wall to which the hanger profile is fastened.

3. The hanger profile according to claim 2, wherein the hanger profile has the at least one through opening provided on the canvas hanger wing.

4. The hanger profile according to claim 1, wherein the hanger profile has the at least one through opening provided on the connecting lining.

5. The hanger profile according to claim 4, wherein the canvas hanger wing is arranged to have an angle of inclination with respect to a third wing of less than 90 degrees.

6. The hanger profile according to claim 1, wherein the second wing and a third wing are arranged to define the slot communicating with the at least one through opening.

7. The hanger profile according to claim 6, wherein the hanger profile includes a deflector in fluid communication with the slot and arranged to deflect air flow through the hanger profile towards the at least one through opening or the slot depending on whether the air enters through the slot or the air enters through the at least one through opening.

8. The hanger profile according to claim 7, wherein the hanger profile includes a plate allowing a separation partition to be supported.

9. The hanger profile according to claim 8, wherein the hanger profile is formed by an association of two distinct parts secured to one another, a first profile part and a second profile part, wherein the first profile part comprises two branches one of the branches of which forms the fastening wing, wherein the second profile part comprises a means of attachment to the first profile part and at least one means for hanging a canvas.

10. The hanger profile according to claim 9, wherein the at least one means of attachment of the second profile part is in the form of an internal groove for receiving an extremity of a horizontal branch of the first profile part, said groove being made in thickness of the second profile part.

11. The profile according to claim 1, wherein the hanger profile comprises at least one cover for closing at least one of the at least one through opening for the passage of air.

12. A ceiling assembly allowing air circulation within a room to be conditioned, the ceiling assembly comprising at least one stretched ceiling defining with an upper slab of the room to be conditioned under which a plenum is mounted, a stretched ceiling comprising at least one stretched canvas extending between walls of the room to be conditioned and fixed to the walls by means of hanger profiles, at least one of the hanger profiles being a hanger profile according to claim 1 so as to allow the passage of air between the plenum and the room to be conditioned.

13. The ceiling assembly according to claim 12, wherein the wings of the hanger profile are arranged to define a slot communicating with the at least one through opening and oriented so that air exiting from the plenum circulates along the wall on which said hanger profile is fastened.

14. The ceiling assembly according to claim 13, wherein the plenum has first and second spaces separated by a separation lining, the first space defining a plenum space for entry of air into the room, the second space defining a plenum space for air to exit from the room.

15. The ceiling assembly according to claim 12, wherein the ceiling assembly comprises a plenum delimited by a stretched ceiling mounted in a room adjacent to the room to be conditioned and the upper slab of the adjacent room, said plenum being separated from a plenum of the room to be conditioned by a partition traversed by at least one conduit allowing fluid communication between the two plenums.

16. The ceiling assembly according to claim 15, wherein the ceiling assembly is equipped with at least one of a ventilation system and an air conditioning system fluidly connected to the plenum of the room to be conditioned.

17. The ceiling assembly according to claim 16, wherein the air conditioning system is housed in the plenum of the room adjacent to the room to be conditioned.

* * * * *